US010576735B2

(12) United States Patent
Langhelt

(10) Patent No.: US 10,576,735 B2
(45) Date of Patent: Mar. 3, 2020

(54) PRINTER FOR PRINTING ONTO A SUCCESSION OF OBJECTS

(71) Applicant: Linx Printing Technologies Ltd., St. Ives, Cambridgeshire (GB)

(72) Inventor: Matthew Langhelt, St. Ives (GB)

(73) Assignee: LINX PRINTING TECHNOLOGIES LTD., St Ives, Cambridges (GB)

( * ) Notice: Subject to any disclaimer, the term of this patent is extended or adjusted under 35 U.S.C. 154(b) by 0 days.

(21) Appl. No.: 16/301,651

(22) PCT Filed: May 22, 2017

(86) PCT No.: PCT/GB2017/051419
§ 371 (c)(1),
(2) Date: Nov. 14, 2018

(87) PCT Pub. No.: WO2017/203219
PCT Pub. Date: Nov. 30, 2017

(65) Prior Publication Data

US 2019/0202200 A1 Jul. 4, 2019

(30) Foreign Application Priority Data

May 25, 2016 (GB) ..... 1609184.5

(51) Int. Cl.
*B41J 2/045* (2006.01)
*B41J 11/00* (2006.01)
(Continued)

(52) U.S. Cl.
CPC ..... *B41J 2/04508* (2013.01); *B41J 2/04586* (2013.01); *B41J 3/28* (2013.01);
(Continued)

(58) Field of Classification Search
CPC ..... B41J 2/04508; B41J 3/4073; B41J 3/28; B41J 3/46; B41J 11/0095; B41J 2/04586;
(Continued)

(56) References Cited

U.S. PATENT DOCUMENTS

2002/0041787 A1 4/2002 Thomas et al.
2002/0130461 A1 9/2002 Petersen et al.
(Continued)

FOREIGN PATENT DOCUMENTS

| | | |
|---|---|---|
| DE | 102011056436 | 6/2013 |
| EP | 1449670 | 8/2003 |
| GB | 2250236 | 6/1992 |

*Primary Examiner* — Bradley W Thies
(74) *Attorney, Agent, or Firm* — Lathrop GPM LLP

(57) ABSTRACT

A non-contact printer controls the sensitivity of sensors provided upstream of a print head, to detect the approach of an object. In a calibration operation to set the sensitivity level of the sensors before a printing operation, the printer displays instructions to guide the operator and adjusts the sensor sensitivity to find detection threshold levels for a background (object absent) condition and when the object is present. The calibration results may be stored in association with data identifying the conveyor and the type of object used in the calibration operation. If the same conveyor and/or object type is used again in a later printing operation, the sensitivity level of the sensors can be set using the stored calibration results so that a further calibration operation is not necessary.

16 Claims, 6 Drawing Sheets

(51) Int. Cl.
*B41J 3/46* (2006.01)
*B41J 3/28* (2006.01)
*B41J 3/407* (2006.01)

(52) U.S. Cl.
CPC ..... *B41J 3/4073* (2013.01); *B41J 3/46* (2013.01); *B41J 11/0095* (2013.01); *B41J 11/007* (2013.01)

(58) Field of Classification Search
CPC ..... B41J 11/007; B41J 2002/022; B41J 2/02; B65H 7/20; B65H 7/14; B65B 63/005
See application file for complete search history.

(56) References Cited

U.S. PATENT DOCUMENTS

2007/0229573 A1 10/2007 Takeishi et al.
2014/0210899 A1* 7/2014 Barnes ..... B41J 11/0095 347/19

* cited by examiner

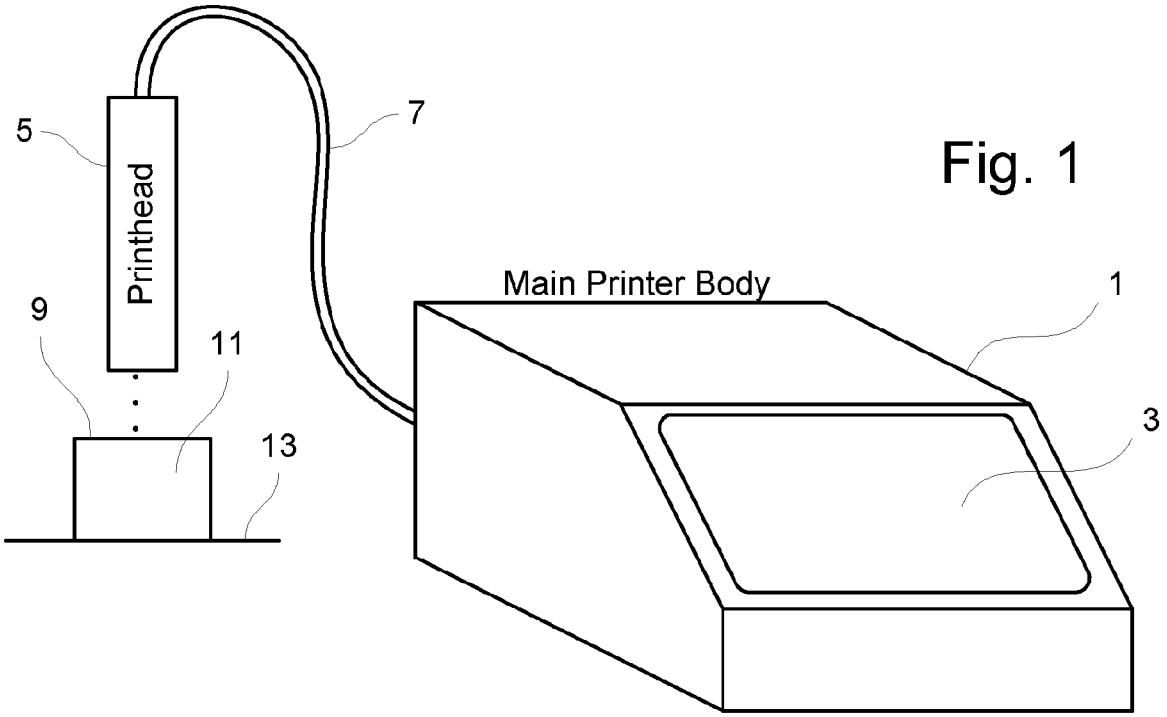
Fig. 1
Fig. 2
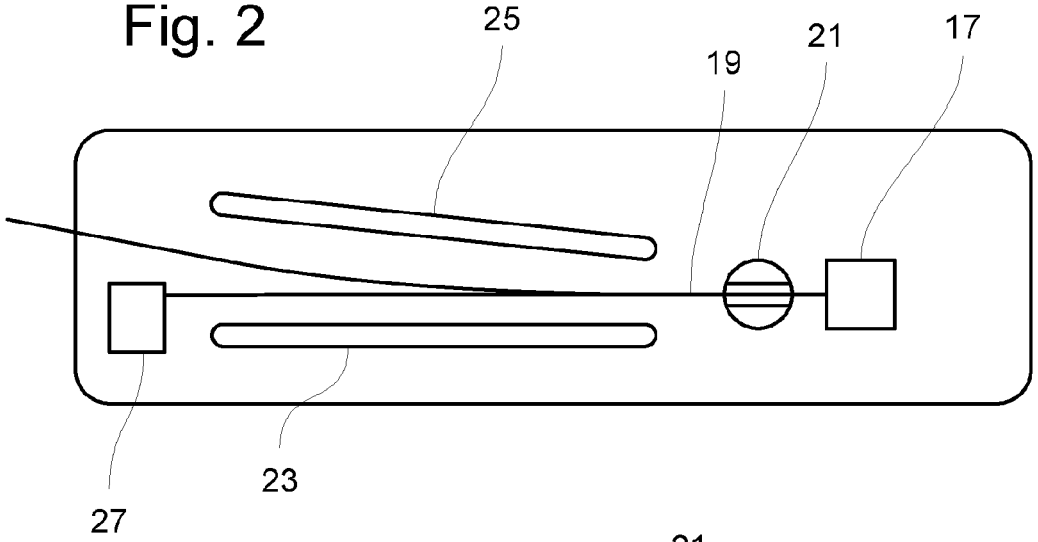
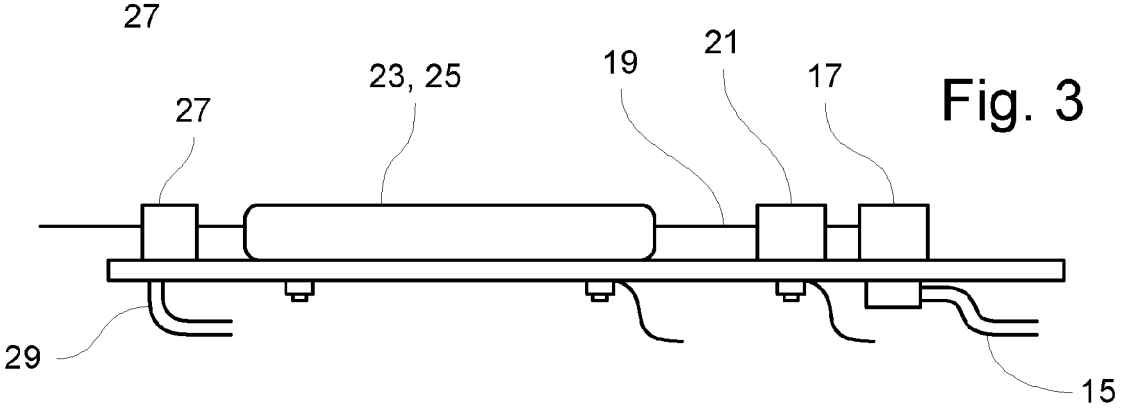
Fig. 3

Fig. 4
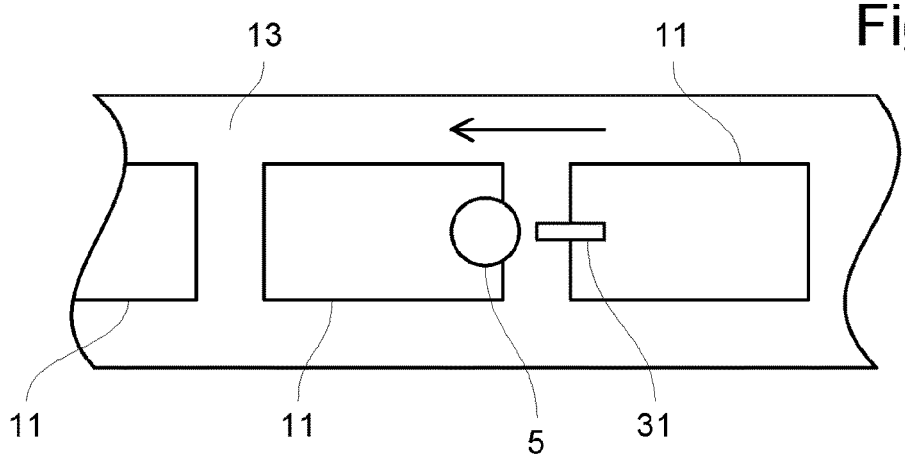
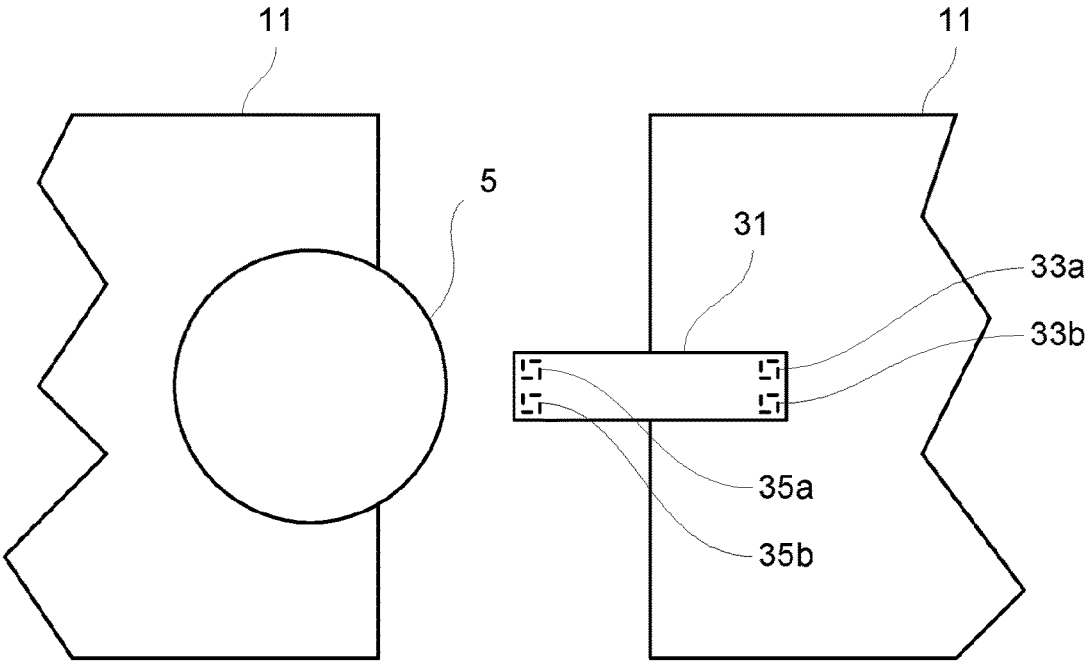
Fig. 5
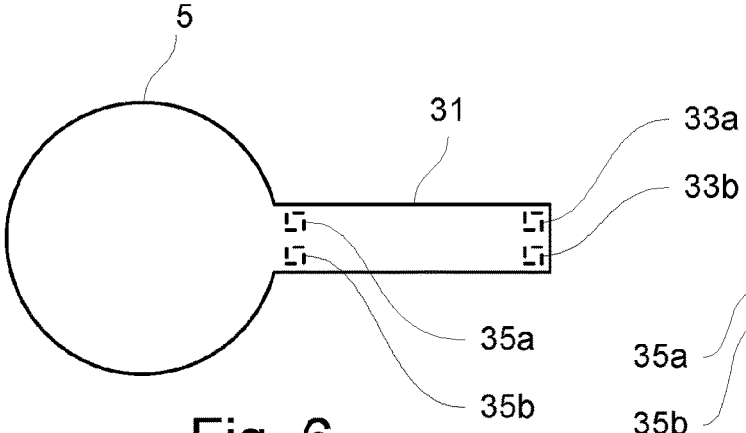
Fig. 6
Fig. 7
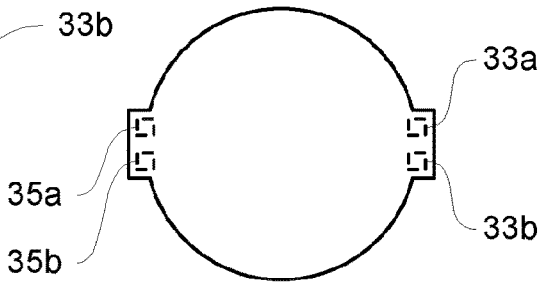

Fig. 9
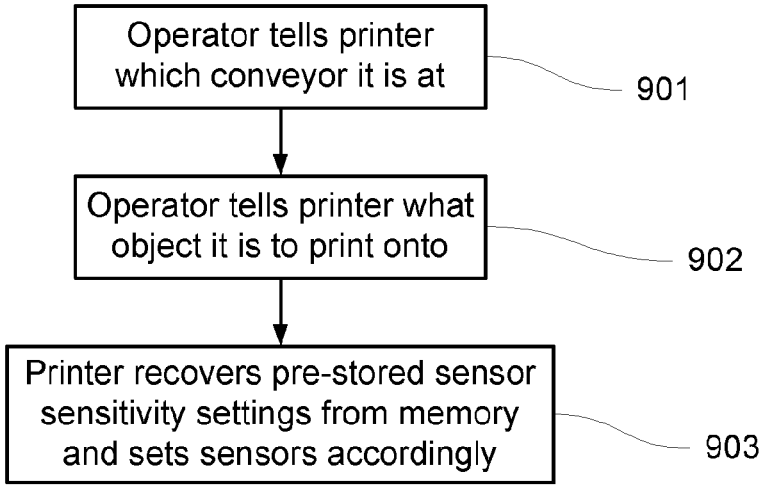
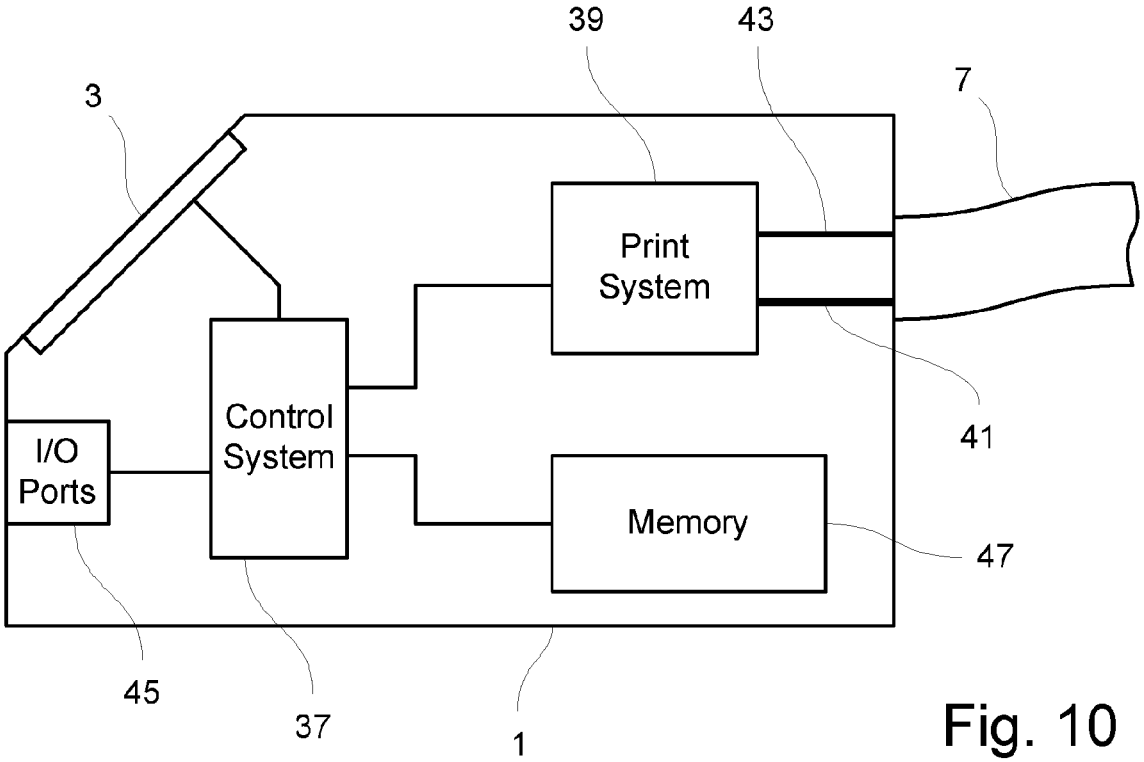
Fig. 10

PRINTER FOR PRINTING ONTO A SUCCESSION OF OBJECTS

TECHNICAL FIELD

The present invention relates to a printer usable for printing onto a succession of objects carried past the printer on a conveyor.

BACKGROUND

Typically, the objects are products such as manufactured articles or packaged food stuffs and the printer is used to print product and batch information, "use by" dates etc. The printer may be a non-impact printer such as an ink jet printers or a laser marker (i.e. lasers that print by directing a laser beam at an object to be printed onto so as to mark the object by changing a surface characteristic of the object). The printer may be a continuous ink jet printer, for example an electrostatic deflection continuous ink jet printer.

In order to position the printing correctly on each object, it is known to use a sensor upstream of the printer to detect an approaching object and trigger printing. In order to position the printing correctly, the system also needs to delay the start of printing, following detection of the approaching object, by the time it takes the object to travel the distance from its position when it is detected to its position for the start of printing. It is known to calculate this delay from the distance to be traveled (which is known) and the line speed (i.e. the speed at which objects are carried past the printer by a conveyor). The line speed may also be used to adjust the printing operation to ensure the correct spacing of the printing in the direction of movement of the objects and to adjust other factors that control print quality. The line speed may be detected using a shaft encoder, or alternatively a second sensor may be used, spaced from the first sensor in the direction of travel of the objects, and the line speed can be calculated from the time taken for an object to travel from one sensor to the other. The sensor or sensors typically comprise a photocell. For example, each sensor may be constructed as a light source and a photodetector positioned close together, so that the photodetector detects light originating from the light source and reflected by an object when the object is present.

In order for the sensors to detect the presence of an object reliably, they must be able to distinguish between the signal received when an object is present and the signal received in the absence of any object. It is common for the sensor to be arranged so that it faces the conveyor surface, with the consequence that the signal detected in the absence of any object depends on the amount of light reflected by the conveyor. This can vary considerably, depending on the design of the conveyor. Additionally, in the case of a traditional belt-type conveyor there is normally a position where the ends of the belts were joined together to make a continuous belt, and the material at the join may be more reflective than the surface of the remainder of the belt.

It is known to provide sensors with an adjustable sensitivity, and a sensor may have a "learn" button for use by an operator to control an operation in which the sensor adjusts its sensitivity. By pressing the "learn" button in a particular way, the operator may cause the sensor to take a reading of the signal received by the photodetector and use it to set a base level representing the signal received when only the visual background is present. By pressing the "learn" button in a different way, the operator may cause the sensor to take a reading of the signal received by the photodetector and use it to set a detection level representing the signal received when a detection signal is required. The sensor then sets its sensitivity to a level between the base level and the detection level. Provided that the operator uses this button correctly, presents the visual background to the sensor for the base level reading and presents a sample object to the sensor for the detection level reading, the sensor can be set to distinguish reliably between the background and the objects.

SUMMARY

Aspects of the present invention use the printer to control the sensor during an operation to adjust its sensitivity, so that the operator does not need to use a "learn" button on the sensor.

In a typical embodiment of the present invention the printer is usable for printing onto an object that is carried on a packing, filling or other product conveying line. Normally the objects are carried past a print head by a conveyor that is external to the printer. Although the objects on the conveyor might be flat sheets, the printer is not limited to printing onto flat sheets. In these ways, the printer differs from a typical sheet printer, such as is used for printing text and images output from a computer onto sheets of paper or similar material. The sensors will usually be reflection type sensors, in which radiation is emitted from the sensor and the presence of an object is sensed by the detection of radiation reflected by the object. This can be contrasted with a beam interruption type sensor, in which radiation is emitted from the sensor and the presence of an object is sensed by the interruption of the detection of the radiation as the object passes between the emitter and the detector.

An aspect of the present invention provides a printer having a print head usable to print onto objects moved past a print location of the print head in a conveying direction, the printer comprising at least one sensor upstream (with reference to the conveying direction) of the printing location for detecting objects approaching the printing location, and the printer having a sensor calibration mode of operation in which it varies the sensitivity of the sensor to detect a background threshold sensitivity that is the limit of the sensor's ability to detect a signal after the operator has confirmed that the sensor is in a state in which no object should be detected, and detects an object threshold sensitivity that is the limit of the sensor's ability to detect a signal following confirmation from the operator that the sensor faces an object to the detected, and sets a sensitivity level for the sensor during a subsequent printing operation at a level between the background threshold sensitivity and the object threshold sensitivity. Preferably the printing sensitivity level is stored and/or the background threshold sensitivity and the object threshold sensitivity are stored. The stored sensitivity level or levels may be associated in the printer's memory with an identification of the conveyor used to carry objects past the printer and/or an identification of the type of objects.

The printer may be a non-impact printer. It may be an ink jet printer or a laser marker.

Because the operation for calibrating the sensor is controlled from the printer, the printer can be set up to provide instructions and information to the operator on a display screen, which is already present in the printer to enable it to communicate with the operator during other parts of printer setup and during printing. This can be useful, as compared with trying to calibrate a sensor by setting the sensor into a "learn" mode, if the operations for putting the sensor into the "learn" mode and using it in that mode are not intuitively obvious and the sensor's instruction manual has been mislaid. Additionally, if the printer has more than one sensor (for example two sensors spaced in the conveying direction in order to measure conveying speed), the printer can control multiple sensors to be calibrated simultaneously, since it will normally be straightforward to set up the background environment for multiple sensors at the same time. This makes the calibration operation quicker and easier for the operator than if each sensor had to be calibrated separately.

Additionally, it is normal that the type of object being printed onto will change from time to time. For example, if the objects are product items, there may be a packaging and printing run of one product and then a packaging and printing run of a different product. The different products may have different appearances, and in particular may have different reflectivities, and therefore it may be necessary, or at least advantageous, to recalibrate the sensor when the type of object is changed. Furthermore, different manufactured products may have different printing requirements so that, depending on the product being conveyed, a commercial conveying line may require no printers, one printer or two printers. As a result, in order to make best use of the available printers, individual printers may be moved from one line to another. Even nominally identical different conveyors may have different reflection characteristics, and therefore the background level required for calibrating the sensor will change from conveyor to conveyor, so that re-calibration is necessary when the printer is moved from one line to another.

However, the optical characteristics of a particular product will not normally change over time and the optical characteristics of a particular conveyor will not normally change over time. Therefore, by storing sensor calibration data in the memory of the printer, it is not always necessary to repeat the calibration operation when the type of object conveyed past the printer changes or if the printer is moved to a new conveyor. If calibration with that type of object or that conveyor has already taken place and the data is stored in the printer memory, it may be sufficient simply to identify the product and/or the conveyor to the printer and the printer can set the sensor to the appropriate sensitivity on the basis of data retrieved from its memory without the need to repeat the calibration operation. This can significantly reduce the time and effort involved in setting the printer up for printing on a new product or setting it up after it is moved from one conveying line to another.

In an aspect of the present invention, a non-contact printer controls the sensitivity of sensors provided upstream of a print head, to detect the approach of an object to be printed onto. In a calibration operation to set the sensitivity level of the sensors before a printing operation, the printer displays instructions to guide the operator and adjusts the sensor sensitivity to find detection threshold levels for a background (object absent) condition and when the object is present. The calibration results can be stored in association with data identifying the conveyor and the type of object used in the calibration operation. If the same conveyor and/or object type is used again in a later printing operation, the sensitivity level of the sensors can be set using the stored calibration results so that a further calibration operation is not necessary.

Another aspect of the invention provides a non-contact printer comprising a print head for printing onto a succession of objects carried past the print head by a conveyor, at least one sensor for detecting the approach of an object to be printed onto, control means and a user interface, the printer having a sensor calibration mode in which (i) it instructs the operator, via the user interface, to present a background condition to the sensor and, following an input from the operator that a background condition has been presented to the sensor, controls the sensor so as to determine the background threshold sensitivity level of the sensor, the background threshold sensitivity level of the sensor being the sensitivity level of the sensor such that at higher sensitivities the sensor provides a detection output when the background condition is presented to the sensor and at lower sensitivities the sensor fails to provide a detection output when the background condition is presented to the sensor, and (ii) it instructs the operator, via the user interface, to present a sample object to the sensor for detection and, following an input from the operator that a sample object has been presented to the sensor, controls the sensor so as to determine the object threshold sensitivity level of the sensor, the object threshold sensitivity level of the sensor being the sensitivity level of the sensor such that at higher sensitivities the sensor provides a detection output when the sample object is presented to the sensor and at lower sensitivities the sensor fails to provide a detection output when the sample object is presented to the sensor, the printer being arranged to control the sensor so that during a printing operation subsequent to operation in the sensor calibration mode, the sensor has a printing sensitivity level that is between the background threshold sensitivity level and the object threshold sensitivity level.

Another aspect of the invention provides a method of operating a non-contact printer having a print head for printing onto a succession of objects carried past the print head by a conveyor, at least one sensor for detecting the approach of an object to be printed onto, and a user interface, the method comprising (i) instructing the operator, via the user interface, to present a background condition to the sensor and, following an input from the operator that a background condition has been presented to the sensor, controlling the sensor so as to determine the background threshold sensitivity level of the sensor, the background threshold sensitivity level of the sensor being the sensitivity level of the sensor such that at higher sensitivities the sensor provides a detection output when the background condition is presented to the sensor and at lower sensitivities the sensor fails to provide a detection output when the background condition is presented to the sensor, (ii) instructing the operator, via the user interface, to present a sample object to the sensor for detection and, following an input from the operator that a sample object has been presented to the sensor, controlling the sensor so as to determine the object threshold sensitivity level of the sensor, the object threshold sensitivity level of the sensor being the sensitivity level of the sensor such that at higher sensitivities the sensor provides a detection output when the sample object is presented to the sensor and at lower sensitivities the sensor fails to provide a detection output when the sample object is presented to the sensor, and (iii) subsequently controlling the sensor during a printing operation so that the sensor has a printing sensitivity level that is between the background threshold sensitivity level and the object threshold sensitivity level.

Further aspects of the invention and optional features are set out in the accompanying claims The printer may be an ink jet printer. It may comprise means for deflecting the ink drops in flight, so that different drops can travel to different destinations. Typically, the ink is electrically conductive when wet, and the printer comprises an arrangement of electrodes to trap electric charges on the ink drops and create electrostatic fields in order to deflect the charged drops.

Normally, the ink jet printer has a print head that is separate from the main printer body and is connected to the main printer body by a flexible connector sometimes known as a conduit or umbilical that carries fluid and electrical connections between the print head and the main printer body. The print head includes an ink gun that receives pressurised ink and allows it to exit through an orifice to form a jet of ink, a charge electrode for trapping electric charges on drops of ink, deflection electrodes for creating an electrostatic field for deflecting charged drops of ink, and a gutter for collecting drops of ink that are not used for printing. The umbilical will include fluid lines, for example for providing pressurised ink to the ink gun and for applying suction to the gutter and transporting ink from the gutter back to the main printer body, and electrical lines, for example to provide a drive signal to a piezoelectric crystal or the like for imposing pressure vibrations on the ink jet, to provide electrical connections for the charge electrode and the deflection electrodes, and to provide drive currents for any valves that may be included in the print head.

Embodiments from the present invention, given by way of non-limiting example, will be described as reference to the following drawings.

BRIEF DESCRIPTION OF THE DRAWINGS

FIG. 1 shows an ink jet printer embodying the present invention.

FIG. 2 is a schematic top view of the print head of the printer of FIG. 1.

FIG. 3 is a schematic side view of the print head of the printer of FIG. 1.

FIG. 4 is a schematic plan view showing the print head positioned to print onto objects on a conveyor.

FIG. 5 is an enlarged view of part of FIG. 4, showing the sensors associated with the print head.

FIG. 6 shows an alternative construction, in which the sensors are attached to the print head.

FIG. 7 shows a further alternative construction, in which the sensors are incorporated into the print head.

FIG. 9 is a flow diagram for setting the sensors using stored data.

FIG. 10 shows some of the main components in the main body of the printer.

DETAILED DESCRIPTION

Figure 8:
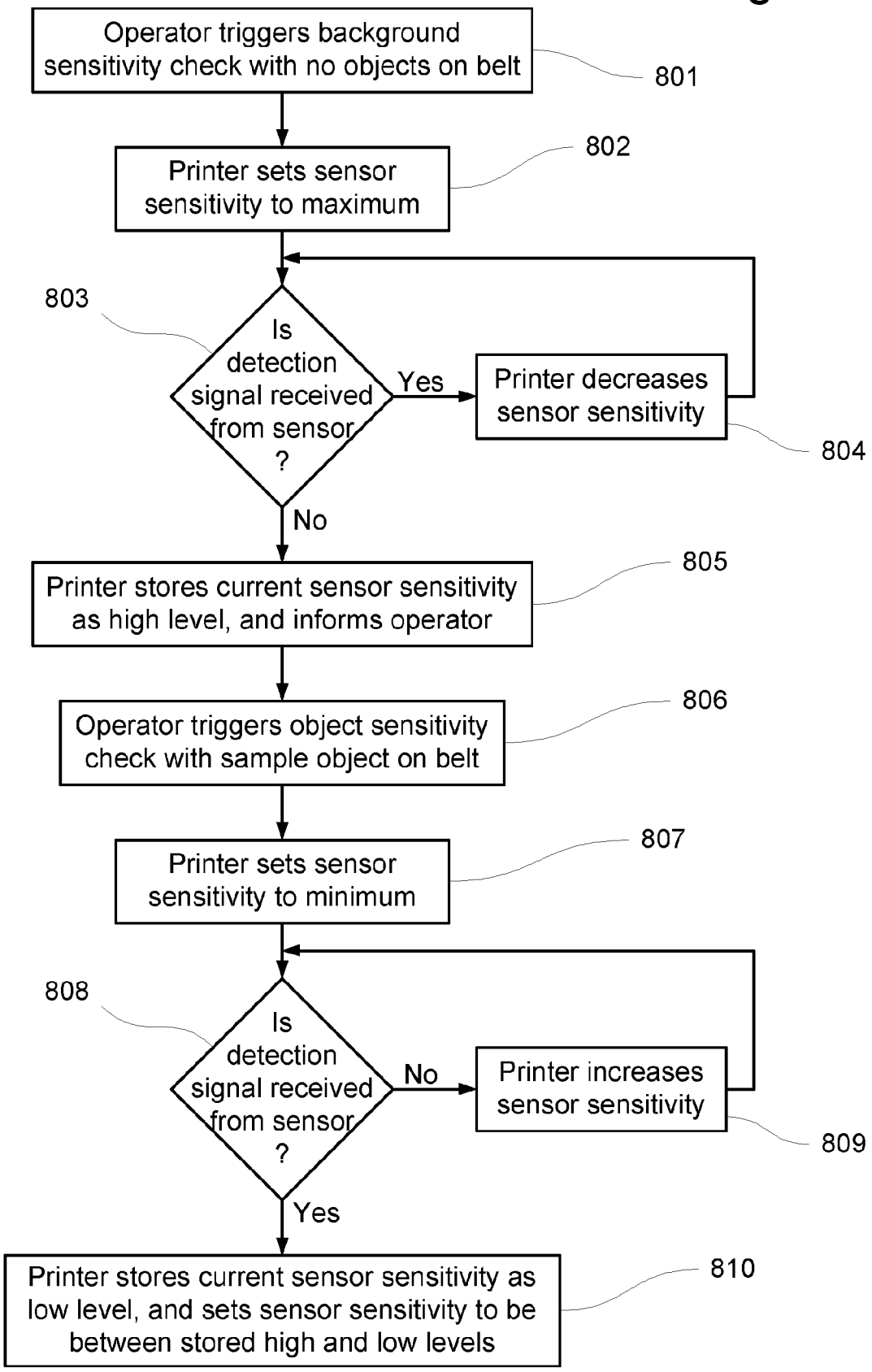
FIG. 8 is a flow diagram for a sensor calibration routine.

The illustrated embodiments of the present invention use an ink jet printer. The ink jet printer may be a continuous ink jet printer such as an electrostatic deflection continuous ink jet printer.

FIG. 1 shows an electrostatic deflection type continuous inkjet printer. The printer forms a continuous jet of ink and has an arrangement of electrodes for charging drops of ink and deflecting the drops electrostatically in order to print a desired pattern. The main fluid and electrical components are housed within a main printer body 1. An operator communicates with the printer via a touchscreen display 3. The ink jet is formed within a print head 5, which also includes the electrode arrangement for charging and deflecting the ink drops, and the print head 5 is connected to the main printer body 1 by a flexible connection 7 known as a conduit or an umbilical. Drops of ink, deflected as necessary to create the desired pattern, travel from the print head 5 and strike the surface 9 of an object 11 conveyed past the print head 5 on a conveyor 13, in order to print the desired pattern on the surface 9 of the object.

The object 11 may be a manufactured product item, such as a bottle or can of drink, a jar of jam, a ready meal, or a carton containing multiple individual items. The desired pattern may comprise product information such a batch number or a "use by" date. The printer may print onto the object 11 from the side so that the ink jet travels in a direction generally across the conveyor, or from above so that the ink jet travels in a direction generally towards the conveyor. For example, bottles are normally printed onto from the side whereas ready meals are normally printed onto from above. In FIG. 1 the printer is set up to print from above.

FIG. 2 is a schematic top view and FIG. 3 is a schematic side view of the main components of the print head 5. The terms "top view" and "side view" represent conventional directions from which to view the print head and do not necessarily correspond to the orientation of the print head when in use.

Pressurised ink, delivered from the main printer body 1 through the umbilical 7, is provided via an ink feed line 15 to an ink gun 17. The pressurised ink leaves the ink gun 17 through a small jet-forming orifice to form an ink jet 19. Provided that pressurised ink is received by the ink gun 17 and any valves in the ink gun 17 are in the appropriate state, the ink jet 19 is formed continuously. Accordingly, this type of ink jet printer is known as a continuous ink jet printer, by contrast with a drop-on-demand printer in which a drop of ink is ejected only when a dot is to be printed.

Although the ink jet 19 leaves the ink gun 17 as a continuous unbroken stream of ink, it rapidly breaks into separate drops. The path of the ink jet passes through a slot in a charge electrode 21, which is positioned so that the ink jet 19 separates into drops while it is in the slot through the charge electrode 21. The ink is electrically conductive and the ink gun 17 is held at a constant voltage (typically ground). Accordingly, any voltage applied to the charge electrode 21 induces a charge into the part of the ink jet 19 that is in the slot of the charge electrode 21. As the ink jet 19 separates into drops, any such charge is trapped on the drops. Accordingly, the amount of charge trapped on each drop can be controlled by changing the voltage on the charge electrode 21.

The ink jet 19 then passes between two deflection electrodes 23, 25. A large potential difference (typically several kilovolts) is applied between those electrodes 23, 25 to provide a strong electric field between them. Accordingly, the drops of ink are deflected by the electric field and the amount of deflection depends on the amount of charge trapped on each drop. In this way, each ink drop can be steered into a selected path. As shown in FIG. 2, uncharged ink drops, which pass through the electric field without deflection, travel to a gutter 27 where they are caught. Suction is applied to the inside of the gutter 27 by a suction line 29, and so the ink received by the gutter 27 is sucked away and returned through the umbilical 7 to the main printer body 1, for reuse.

Drops of ink that are deflected by the field between the deflection electrodes 23, 25, so as to miss the gutter 27, leave the print head 5 and form printed dots on the surface 9 of the object 11.

FIG. 4 is a schematic plan view showing the print head 5 positioned to print onto the surfaces 9 of a plurality of product items or other objects 11 that are carried past the print head 1 by a conveyor 13, which carries the items 11 in the direction shown by the arrow. The conveyor is typically part of an industrial conveying line such as a product filling line or a product packaging line. The print head 5 is associated with a sensor block 31 mounted immediately upstream of it. The sensor block 31 carries sensors that face towards the conveyor 13 in order to detect each object 11 just before it reaches the print head 5.

FIG. 5 provides an enlarged view of the print head 5 from the sensor block 31. At the upstream end of the sensor block 31 there is a first sensor 33 made up of a light source 33*a* and a photodetector 33*b*. The first sensor 33 detects the presence of an object 11 because the object 11 reflects light from the light source 33*a* back to the photodetector 33*b*. At the downstream end of the sensor block 31 there is a second sensor 35, which comprises a light source 35*a* and a photodetector 35*b* in a similar way to the first sensor 33. The sensors 33, 35 are mounted on the sensor block 31 a known distance apart, and the sensor block 31 is mounted at a known distance upstream of the print head 5. When a signal is received from one of the sensors 33, 35, indicating that it has detected the presence of an object 11, this informs the printer that the approaching object is a specific known distance from the print head 5. This is used to trigger a delay (which is set depending on the magnitude of the known distance and the speed of movement of the conveyor 13), before the printer begins to print onto the object 11, thereby ensuring that the printer output is positioned correctly on each object 11. Either of the sensors 33, 35 may be used to trigger the delay before printing.

In order for the delay to be set correctly, and also in order for the printing pattern to be formed correctly on the object 11, the printer needs to know the speed at which the objects 11 are moving (i.e. the line speed of the conveyer 13). Although it is possible for the printer to obtain this speed information from a shaft encoder or other similar means, the sensor block 31 of the present embodiment enables the printer to determine the line speed directly from the sensor outputs. Because the sensor block 31 has two sensors 33, 35 that are spaced a known distance apart, the time delay between a detection output from the first sensor 33 and a detection output from the second sensor 35 enables a direct measurement to be made of the speed of movement of the detected object 11.

In FIGS. 4 and 5, the sensor block 31 is physically separate from the print head 5, and the distance between the sensor block 31 and the print head 5 has to be known by the printer. Typically, this distance will be measured once the print head 5 and the sensor block 31 have been mounted in position, and this distance is entered into the printer as part of a set up operation. However, this step can be avoided, and the set up operation simplified, by attaching the sensor block 31 to the print head 5 or combining them into a single integrated unit, as shown in FIG. 6. Because the sensor block 31 is attached to or integrated with the print head 5, the position of each sensor 33, 35 relative to the print head 5 is fixed and can be pre-stored in the printer. Therefore the operator only has one item to fix in position over the conveyor 13 and there is no need to measure the distance between the sensor block 31 and the print head 5 and to enter the measured distance into the printer.

A neater construction can be obtained by eliminating the sensor block 31 and fitting the sensors 33, 35 one each side of the print head 5, as shown in FIG. 7. In this case, the second sensor 35 is downstream (with reference to the direction of movement of the objects 11) of the printing location of the print head 5, and therefore does not detect the presence of an object 11 until the leading edge (at least) of the object 11 has already past the printing location. Therefore the first sensor 33 should be used to trigger the print delay in this case. Additionally, the line speed cannot be calculated until the leading edge of the object 11 reaches the second sensor 35, so that the line speed calculated from detecting a particular object 11 may not be available in time for it to be used in setting the length of the print delay for printing onto that object. However, since the speed of the conveyor 11 will normally vary only gradually, it is sufficient for the printer to use the line speed calculated by detecting the previous object 11 and the arrangement of sensors shown in FIG. 7 is adequate to detect gradual changes in the line speed over time.

In order for the sensors 33, 35 to detect the object 11 reliably, they must be sufficiently sensitive that an output is provided from the photodetectors 33*b*, 35*b* when the object 11 passes the sensors 33, 35, but the sensors should not be so sensitive that they provide an output when no object 11 is present. Different types of object 11 may have different reflectivities. The surface of the conveyor 13 will also reflect light to some extent, and different conveyors 11 may reflect light differently. Consequently it is often necessary to perform an operation to calibrate the sensors 33, 35 so that they do not respond to the conveyor 13 but do respond to the objects 11.

It is possible for each sensor 33, 35 to send a continuous signal to the printer (typically in analogue form), and for the printer to compare the signal with a trigger threshold level so that the sensor is regarded as providing a detection output whenever the received sensor signal changes from being below the trigger threshold level to being above it. In the calibration operation, the trigger threshold level is set to an appropriate value to ensure that the signal received when there no object 11 is present, and the sensor only sees the conveyor 13, is always below the trigger threshold level and the signal provided when an object 11 passes underneath a sensor is always above the trigger threshold level.

However, in practice it is normal for each sensor 33, 35 to include a circuitry defining the trigger threshold level and for the sensor to be able to vary the level in response to a received sensitivity control input. In this case, the comparison operation between the output of the photodetector 33*b*, 35*b* and the trigger threshold level is performed in the sensor 33, 35 itself, and the sensor has a simple two level output with one level being provided whenever no object 11 is present and the other being provided (continuously or as a brief pulse) when an object 11 is detected.

In the present embodiment, the operation to calibrate the sensors 33, 35 is performed using the printer, and the sensors 33, 35 are connected so that each sensor receives a sensitivity control input from the printer. FIG. 8 is a flow diagram for a sensor calibration routine.

In step 801 the operator initiates the sensor calibration routine and sets up the sensors to detect the background level of detected light that needs to be insufficient to trigger a sensor detection output. Since the vibrations in the conveyor 13, especially if it is a belt, may create fluctuations in the level of reflected light, and may result in moments of higher light reflection than is obtained from a stationary belt, the operator may set the conveyor 13 going with no objects on it. Alternatively, if the conveyor 13 has one particular portion with higher reflectivity than the rest (for example, the region around the end join in a continuous belt), the operator may arrange for the conveyor 13 to be stationary with this particular portion directly under the sensors 33, 35. It may also be the case that the product itself has portions of significantly different reflectance, and the printer needs to ignore an initial part of each product item 11 and print on a subsequent part. For example, it is common for a ready meal to be sealed by a thin transparent film and then to have a cardboard sleeve that passes around only part of the overall package, and the printer needs to be set up to ignore the initial part of each object, where the container or the food is visible through the transparent film, and print only onto the cardboard sleeve. In this case, the operator may set up the sensors 33, 35 so that they face the initial portion (that needs to be ignored) of an object 11.

Once the operator has set up whatever background environment for the sensors 33, 35 is desired, he informs the printer. Then, in step 802 the printer sets the sensor or sensors 33, 35 to maximum sensitivity and in step 803 the printer determines whether a detection signal is received from the sensor. If a signal is received, the routine flows to step 804 in which the printer decreases the sensitivity of the sensor and then returns to step 803. The routine continues around the loop formed by steps 803 and 804, steadily reducing the sensor sensitivity until no signal is received from the sensor. Then the routine flows to step 805 in which the printer stores the sensitivity setting for the sensor that has resulted in no signal being received. This represents a "background threshold" or "high" sensitivity level, being the maximum sensitivity level possible for the sensor that still allows the sensor not to provide a detection output in the background environment.

In the case where more than one sensor is present, as in the arrangements shown in FIGS. 5 to 7, the printer can carry out steps 803 to 805 simultaneously but separately for each sensor and may store different values as the high level or "background threshold" level for different sensors in step 805, in order to take account of slight differences in inherent sensitivity between different sensors or slight differences in illumination between the positions of the two sensors.

After the printer has stored the "background threshold" sensitivity level in step 805 it informs the operator that the background level detection is completed. Then in step 806 the operator places a sample object 11 in position to be detected by the sensors 33, 35 and informs the printer when the sample object is in position. Then in step 807 the printer sets the sensor sensitivity to its lowest value and in step 808 the printer checks whether any detection signal is received from the sensor. If no signal is received, the routine flows to step 809 and the printer increases the sensitivity of the sensor. The routine then returns to step 808 and the printer checks again whether any detection signal has been received from the sensor. The routine continues around the loop formed by steps 808 and 809 steadily increasing the sensitivity of the sensor until a detection signal is received.

When a detection signal is received, the routine flows to step 810. In this step, the printer stores the current sensitivity level of the sensor as an "object threshold" or "low" level. This is the lowest sensitivity setting for the sensor that will enable the object 11 to be detected.

In order to enable the sensor or sensors 33, 35 to respond reliably to the presence of object 11 while not giving outputs in the absence of any object 11, the printer sets the sensor or sensors 33, 35 to an operating sensitivity level between the stored high "background threshold" level and the stored low "object threshold" sensitivity level. The operational sensitivity level may be half way between the stored levels, but other settings are possible. For example, if there is a large difference between the two stored levels it may be preferred to set the normal operational level slightly closer to the low "object threshold" sensitivity level than to the high "background threshold" sensitivity level, to ensure more reliable rejection of optical noise during the print operation.

It is preferred that the sensor itself contains the circuitry that determines its sensitivity, and this circuitry responds to control signals sent by the control system 37 of the printer. However, it is possible that a sensor 33, 35 sends an analogue signal to the main body 1 of the printer and that this analogue signal is compared with a trigger level in the main body 1 such that a detection signal is provided if the level of the analogue signal from the sensor exceeds the trigger level. In this case, the sensitivity of the sensor is varied by varying the trigger level. Although the variation of the trigger level takes place inside the main body 1 of the printer, this is still regarded as a situation in which the control system 37 of the printer controls the sensor to adjust its sensitivity level, and the circuitry in which the analogue level is compared with the trigger level and the circuitry that varies the trigger level are regarded as being parts of the sensor that happen to be located inside the main printer body 1.

During the operation to set up the printer for printing onto a particular type of object, such as items of a particular product, the operator may also enter an ID code for the object type or product into the printer, so that the printer will retrieve from its memory what information and print layout should be used to create the pattern to be printed onto the objects. In this case, the printer may also store the operational sensitivity level for the sensor or each of the sensors in association with the product ID, or alternatively may store the "object threshold" level and possibly also the "background threshold" sensitivity level in association with the product ID. Additionally, it is often the case that a printer is used in an environment where there are multiple conveyors 13, and the operator may enter an ID code for the particular conveyor that the printer is positioned at, and this conveyor line ID may also be stored in association with the operational sensitivity of the sensor or the "background threshold" sensitivity level and possibly also the "object threshold" sensitivity level for the sensor.

In the normal operation of a business having one or more conveyors 13, it is common that the product passing down a conveyor 13 changes from time to time, so that the printer has to be set up for printing onto the new product. Additionally, the need for printing at a particular conveyor 13 may vary depending on the nature of the objects 11 being carried by the conveyor 13, and accordingly a printer may be moved from one conveyor 13 to another. Because different products and different conveyors may have different reflectivities, the optimum operational sensitivity levels of the sensors 33, 35 may change with a change of product or a change of conveyor. However, the reflectivity of a particular product or a particular conveyor is likely to remain substantially constant. Accordingly, if the printer has previously been set up for printing onto a particular product being carried on a particular conveyor, and the sensor sensitivity levels for that combination of product and conveyor have been stored in the printer as discussed above, it may not be necessary to perform the sensor calibration operation of FIG. 8 if the printer is once again being set up to print onto that same product on that same conveyor. Instead, the necessary settings can simply be retrieved from memory and applied to the sensors 33, 35. For example, the operator can perform an operation as shown in the flow diagram of FIG. 9.

When the operator gets to the point of setting the sensitivity of the sensors 33, 35 during the printer set up operation, the operator informs the printer in step 901 of the identification of the conveyor 13 where the printer is set to print. If the printer has not been moved, this information may already be stored in the printer and this step can be omitted. In step 902, the operator enters information into the printer to identify the product (or type of object) to be printed onto. In step 903, the printer uses the information about the product and the conveyor to retrieve from its memory pre-stored information about sensitivity settings for the sensors 33, 35 and sets the operational sensitivities for the sensors during the printing operation in accordance with the retrieved information. In this way, the sensors 33, 35 can be set up with the correct sensitivity levels without the need to perform another calibration operation, which makes the operation to set up the printer quicker and simpler for the operator.

FIG. 10 shows some of the main components in the main body 1 of the printer. A control system 37 controls the printer, and a print system 39 performs print operations under the control of the control system 37. The print system 39 includes fluid handling components such as pumps, valves, ink and solvent tanks and associated fluid lines, and also electrical components for operating some of the fluid handling components and for providing electrical signals to other components such as the charge electrode 21 and the deflection electrodes 23, 25. Fluid lines 41 and electrical lines 43 extend from the print system 39 to the print head 5 through the umbilical 7. In practice, the print system 39 also includes some components in the print head 5, such as the ink gun 17, the charge electrode 21, the deflection electrodes 23, 25, the gutter 27 and possibly other components such as valves.

Input/output ports 45 allow the control system 37 to communicate with the outside world. The sensors 33, 35 may be connected to the printer via the I/O ports 45 if they are separate from the print head 5. If the sensors 33, 35 are integrated into the print head 5 it may be more convenient for them to be connected to the main printer body via wiring in the umbilical 7. The control system 37 is also connected to the touchscreen display 3 to allow it to communicate with an operator. Data, including data used to generate the pattern to be printed during operation of the printer, is stored in a memory 47. Sensitivity levels for the sensors 33, 35, obtained during the calibration operation of FIG. 8, are also stored in the memory 47

During a printer setup operation, carried out before a print run in which the patterns are printed onto a succession of objects 11 passing down the conveyer 13, the operator will input information via the touchscreen display 3 to enable the control system 37 to set up the printer to perform appropriately. As part of this setup operation, the operator may set the sensitivity levels for the sensors 33, 35 by performing a calibration operation according to FIG. 8. Alternatively, the control system 37 may be able to recover pre-stored sensitivity level information from the memory 47. In order to enable pre-stored sensitivity information to be retrieved from the memory, the operator can enter the identity of the conveyor where the printer is positioned and also indicate what product the printer will be required to print onto. The printer may be set up to assume that it is still at the same conveyor 13 as it was previously at, so that the operator only needs to enter a conveyor identity if the printer has been moved. The control system 27 then uses the product information and the conveyor information to retrieve the relevant sensitivity information from the memory 47 and sets the sensitivity of each sensor 33, 35 accordingly.

During the printer setup operation, the operator will also have to set the printer to print the correct pattern onto the objects 11. If information about the printed patterns is stored in the memory 47 in association with information about the objects to be printed onto, the operator may provide an input that indicates what product the printer will be required to print onto, as part of the routine to set the control system 37 to generate the correct printed pattern. In this case, if the operator comes to set the sensitivity levels of the sensors 33, 35 later in the printer setup operation, the control system has already been told what product will be printed onto and so the operator may not need to enter this information when setting the sensitivity levels of the sensors.

The printer is arranged so that it guides the operator through the printer set up operation by displaying information and instructions on the touchscreen display 3 and providing data entry options through the touchscreen display 3. Since the printer is able to control the sensitivities of the sensors 33, 35 and control the calibration of the sensors 33, 35, the printer can also guide the operator through the sensor calibration operation, giving the operator appropriate information and choices at each stage. This can make the sensor calibration operation easier for the operator than if the sensors had to be calibrated via a "learn" button on each sensor without any interaction with the printer. An example of how the printer can guide the operator through this operation will be described with reference to FIGS. 11 to 14.

Figure 11:
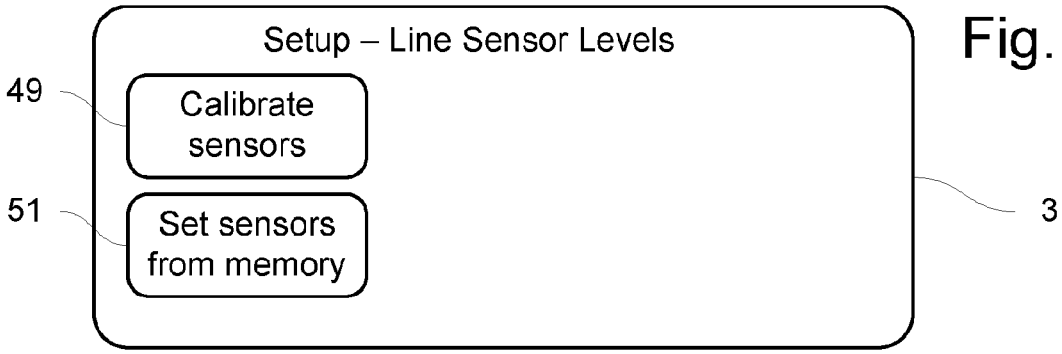
FIG. 11 is a view of the display on the screen of the printer to enter sensor setup.

As an example, FIG. 11 shows an example of part of the view displayed on the touchscreen display 3 when the printer setup operation reaches the point at which the sensitivity levels of the sensors 33, 35 are to be set. The printer displays a heading "Setup—Line Sensor Levels" to inform the operator that this stage has been reached, and gives the operator the option either to calibrate the sensors by touching an area 49 labelled "Calibrate sensors" or to set the sensors from memory by touching an area 51 labelled "Set sensors from memory".

Figure 12:
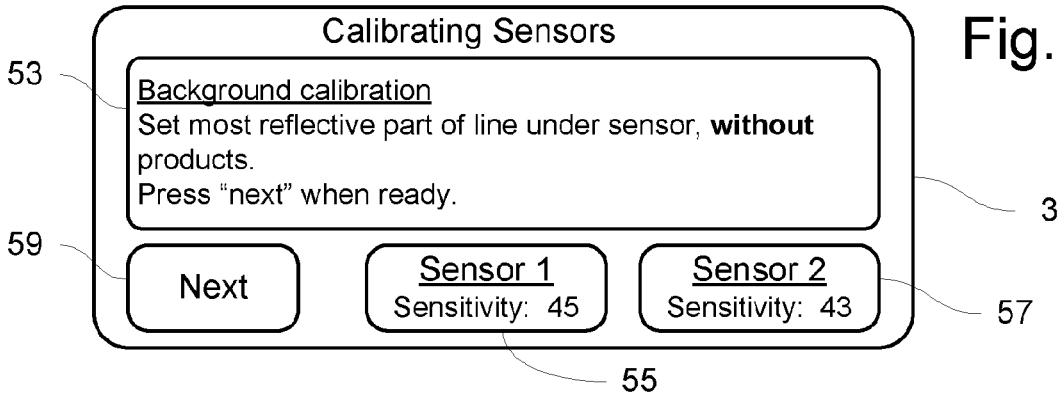
FIG. 12 is a view of the display on the screen of the printer for background calibration of the sensors.

Assuming that the operator chooses to calibrate the sensors, the touchscreen display 3 moves on to the layout shown in FIG. 12. The display now shows the heading "Calibrating Sensors" to confirm to the operator what is happening, and an instruction pane 53 tells the operator how to set up the conveyor 13 for background calibration of the sensors 33, 35. Once the operator has set up the conveyor 13 so that the sensors 33, 35 are facing the desired background environment, he can touch an area 55 marked "Next". This completes step 801 from the flow diagram of FIG. 8. The printer will then perform steps 802, 803, 804 and 805 of FIG. 8. It is not strictly necessary to inform the operator what sensitivity levels have been identified as the "background threshold" level for each sensor. However, in order to keep the operator informed and give him confidence in the operation, the printer displays these levels in sensor information panes 55, 57. Optionally, the printer may display the current sensitivity level of each sensor while it goes round the loop defined by steps 803 and 804, so that the operator can see the sensitivity levels being decreased until the background threshold is reached.

Figure 13:
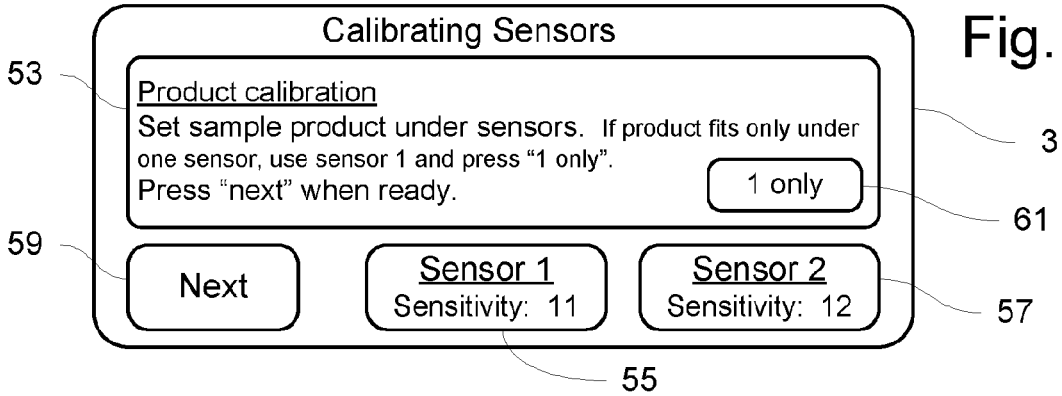
FIG. 13 is a view of the display on the screen of the printer for product calibration of the sensors.

At the end of step 805, the printer changes the view shown on the touchscreen display 3 to the layout shown in FIG. 13. The instruction pane 53 now informs the operator the operation has reached the stage of calibrating the sensors with a sample object 11 present. It instructs the operator to place a sample product under the sensors. The printer may help the operator to position the sample correctly by using the sensors 33, 35 to detect the sample object 11 and making a visual change to the corresponding sensor information panes 55, 57 when the corresponding sensor 33, 35 detects the presence of the object 11. For example, the corresponding sensor information pane 55, 57 can change its colour or brightness level when the sensor detects the object. Once the operator is satisfied that the sample object 11 is correctly positioned, he informs the printer by touching the "Next" area 59 on the touchscreen display 3. This completes step 806 in FIG. 8.

In some circumstances, for example when the printer is being used to print onto the top surface of a bottle cap, the sample object 11 may be too small to fit under both sensors 33, 35 simultaneously. In this case, the operator should set the sample object 11 under the first sensor 33, and the steps to detect the "object threshold" sensitivity can be carried out with this sensor only. The printer can be arranged so that it carries out these steps only with one sensor if it detects the presence of the object under only one sensor when the operator touches the "Next" area 59 in FIG. 13. Alternatively, the printer may be set up to ask the operator explicitly to confirm that the object 11 only fits under one sensor. As shown in FIG. 13, this can be done by providing an appropriate instruction in the "instruction pane" 53, and by providing an additional touch area 61 for the operator to touch in order explicitly to confirm that the object only fits under one sensor. This allows the printer to distinguish between a circumstance in which the object 11 is too small to fit under both sensors 33, 35 simultaneously from a circumstance in which the operator has accidentally mispositioned a large object 11 so that it is in fact under only one of the sensors when it could fit under both of them After the operator has touched the "Next" area 59 in FIG. 13, the printer performs steps 807 to 809 in FIG. 8 to detect the "object threshold" sensitivity level for each sensor 33, 35, i.e. the sensitivity level for each sensor at which it is just able to detect the presence of the sample object 11 placed under the sensors by the operator. As with the display in FIG. 12 and steps 802 to 804 for determining the "background threshold" sensitivity level, the printer may display the sensitivity levels in the sensor information panes 55, 57. Assuming that the sample object 11 fits under both sensors, the "object threshold" sensitivity level for each sensor is determined independently. However, if the sample object 11 only fits under one of the sensors, the "object threshold" can only be determined for that sensor and the printer assumes that both sensors will have the same "object threshold" level.

Figure 14:
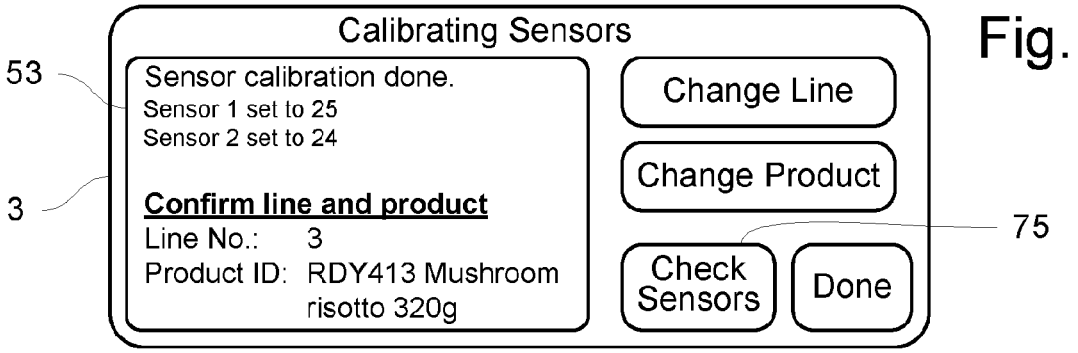
FIG. 14 is a view of the display on the screen of the printer for storing sensor data in memory when calibration of the sensors is complete.

Once the "object threshold" sensitivity level for each sensor 33, 35 has been determined, the printer completes calibration of the sensors by setting each sensor 33, 35 to a sensitivity level between the "background threshold" sensitivity level and the "object threshold" sensitivity level in step 810 of FIG. 8, and displays the results on the touchscreen display 3, for example as shown in FIG. 14. This sensor setting will be specific to particular conveyor line 13 and particular type of object 11, and as discussed above the printer can store this calibration information in association with the line and/or object type. Normally, the identity of the conveyor line 13 and the identity of the product (i.e. type of object) being printed onto will already be known to the printer from information entered into it during a previous stage of the setup process, and accordingly in FIG. 14 the printer displays both the sensitivity levels to which each sensor has been set and also the line number and product ID for which the printer is being set up. The operator has the option to change the stored line number or product in case of error. Otherwise, the operator can touch "Done" to confirm that the line number and product ID are correct and to exit the sensor calibration routine.

Figure 15:
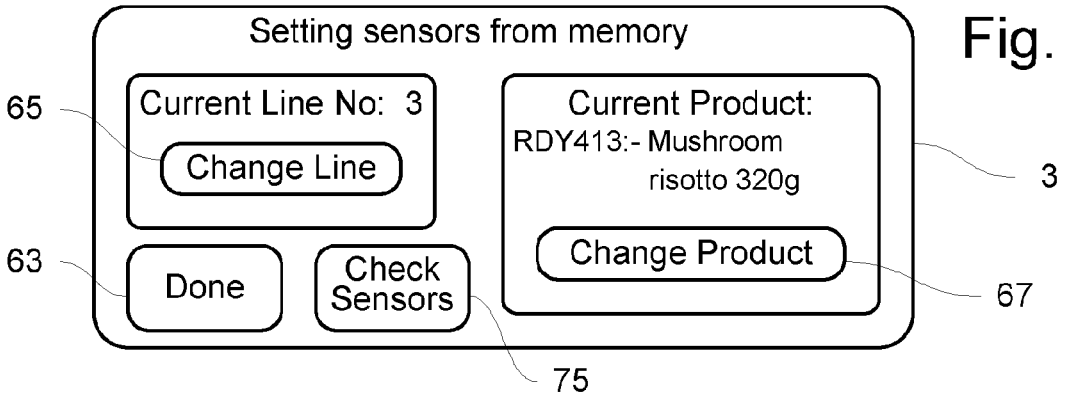
FIG. 15 is a view of the display on the screen of the printer for setting up the sensors from data stored in memory.

As mentioned previously with reference to FIG. 9 and FIG. 11, it is also possible to set the sensitivity levels for the sensors 33, 35 using stored information, avoiding the need to perform a sensor calibration routine, if the relevant information is already present in the memory 47 of the printer. Accordingly, if the operator touches the "Set sensors from memory" area 51 in FIG. 11, the printer provides a view on the touchscreen display 3 such as is shown in FIG. 15. The printer already knows the product that will be printed onto, since this information was entered at an earlier stage of the setup procedure, and unless new conveyor information has been entered into the printer it assumes it is at the same conveyor 13 as it was previously. Accordingly, in FIG. 15 the printer displays the current conveyor line number and the current product ID. Assuming that these are correct, the operator merely has to touch the "Done" area 63 and the printer sets the sensitivities of the first and second sensors 33, 35 using the relevant information stored in the memory 47. In case the displayed conveyor line number or product information in FIG. 15 is incorrect, the operator has the opportunity to change these by touching a "Change line" area 65 or a "Change product" area 67.

Figure 16:
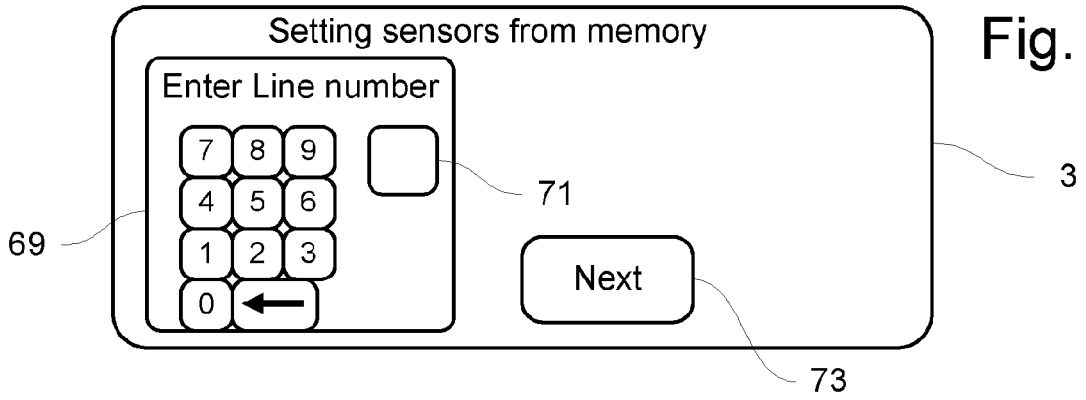
FIG. 16 is a view of the display on the screen of the printer for changing the conveyor line number while setting up the sensors from memory.

FIG. 16 shows the view on the touchscreen display 3 to allow the operator to enter a new line number if the "Change line" area 65 was touched in FIG. 15. This provides a keypad area 69 for entering a new line number and a display area 71 to show the new number that has been entered. When the operator has entered the new line number, the information can be confirmed by touching a "Next" area 73. The printer then displays the view shown in FIG. 15 again, but with the new line number replacing the previous line number.

As an alternative to the keypad area 69 in FIG. 16, the printer can show a list of conveyor lines on the touchscreen display 3 and allow the operator to select the new line e.g. by touching the relevant entry in the displayed list.

Figure 17:
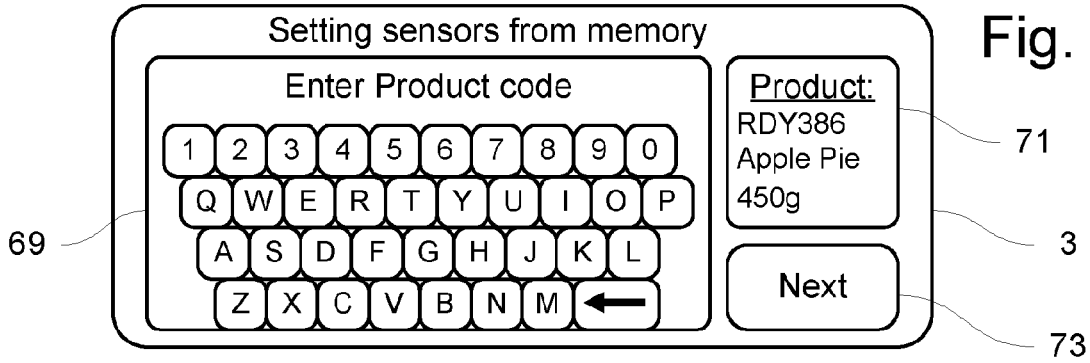
FIG. 17 is a view of the display on the screen of the printer for changing the product ID while setting up the sensors from memory.

FIG. 17 shows the view on the display if the operator touches the "Change product" area 67 in FIG. 15. As in FIG. 16, this view has a keypad touch area 69 for entering the new product ID code, a display area 71 for confirming to the operator the code that has been entered and also displaying a brief description of the corresponding product, and a "Next" touch area 73 to allow the operator to confirm the information. These areas are laid out slightly differently in FIG. 17 since the operator requires a full alpha-numeric keypad in the area 69 in FIG. 17, whereas only a numeric keypad was required in FIG. 16.

In principle, the keypad area in FIG. 17 may also be replaced by a list of possible products, so that the operator can select the correct one. However, since there is likely to be a large number of possible products, it may not be practical to display a list and so the use of a keypad to enter a product code will usually be preferred.

In an alternative arrangement, the printer gives the operator the option to set up as many aspects of the printer as possible from data stored in the memory 47 once the line number and product ID have been entered or confirmed during the printer setup operation, and the printer will include setting up the sensitivities of the sensors 33, 35 from the stored data if this is available, without asking the operator to re-confirm the line number and product ID. In this case the printer will only show the view of FIG. 11 on its display if the sensitivities of the sensors 33, 35 cannot be set from memory and therefore the "Set sensors from memory" touch area 51 would not be present. It is also possible that the view of FIG. 11 would not be used at all, but that the printer would simply inform the operator that the memory did not include stored sensor calibration information and would then go straight the view of FIG. 12 and instruct the operator to begin calibrating the sensors. Since the sensor sensitivities would be set up automatically from memory without further interaction with the operator if the data is available in the memory 47, the views shown in FIGS. 15, 16 and 17 would not be required.

In a further modification, the operator is given the option to check that the sensors are operating satisfactorily following the calibration operation of FIGS. 12 to 14 or the set-up from memory operation of FIGS. 15 to 17. The operator selects this option by touching a "Check Sensors" touch area 75 in FIG. 14 or FIG. 15. The printer then provides a view on the touchscreen display as shown in FIG. 18.

Figure 18:
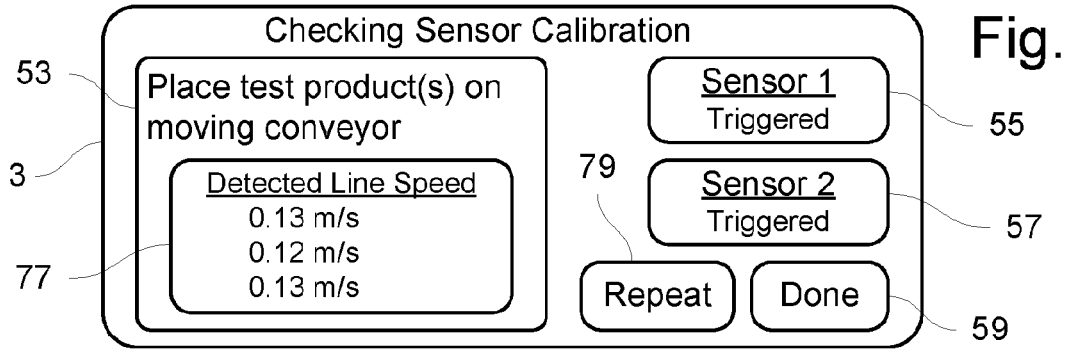
FIG. 18 is a view of the display on the screen of the printer for checking calibration of the sensors.

In FIG. 18 the printer displays a heading "Checking Sensor Calibration" to inform the operator that this check operation is in progress, and an instruction pane 53 instructs the operator to set the conveyor going with products on it, in order to test the sensors. The sensor information panes 55, 57 are displayed, and each sensor information pane changes colour or brightness and also displays the word "triggered" if the corresponding sensor detects an object. Assuming that both sensors 33, 35 detect the object, the printer calculates the conveyor line speed and displays this in a line speed information pane 77. If the conveyor carries several objects 11 past the sensors 33, 35 in the sensor check mode, the printer may be set up to detect each one and calculate the line speed repeatedly. Alternatively, the printer may stop the sensor check after the first object 11 is detected and the operator is given the option to repeat the sensor check by touching a "Repeat" area 79 on the touchscreen display 3. Once the sensor check is completed, the operator can touch the "done" area 59 to exit the sensor set-up operation.

Various other modifications and alternatives are possible. For example, in the calibration operation of FIG. 8 the successive stepwise changes in the printer sensitivity in the loop of steps 803 and 804 and the loop of steps 808 and 809 is not the most efficient way of identifying the threshold sensitivity levels. These steps may be replaced by an alternative search algorithm, for example one based on a binary search algorithm, preferably skewed for an initial search near the maximum sensitivity for the algorithm that replaces steps 803 and 804 and an initial search near the minimum sensitivity for the algorithm that replaces steps 808 and 809.

Additionally, in step 810, if the "background threshold" sensitivity level and the "object threshold" sensitivity level are closer together than a pre-stored limit (or possibly even the thresholds are the wrong way round so that the background is easier to detect than the object), the printer may replace the view shown in FIG. 14 with an alternative view on the touchscreen display 3 that warns the operator that the sensors 33, 35 cannot reliably distinguish the sample object 11 from the visual background, and therefore the printer will be unable to detect objects in order to print on.

In FIG. 8 and FIGS. 12 and 13, the "background threshold" sensitivity level for the sensors 33, 35 is determined before the "object threshold" sensitivity level. However, this is not necessary and these threshold levels could be determined in the opposite order.

Because the sensors 33, 35 are controlled from the printer, the printer is able to guide the operator through the sensor calibration operation by displaying instructions in the instruction pane 53 and by providing the operator with touch areas that make it convenient for the operator to interact with the printer. This makes it easier for the operator to calibrate the sensors compared with using a "learn" mode in the sensor, especially if more than one sensor needs to be calibrated. Additionally, the operator does not have to remember how to conduct the calibration operation because the instructions from the printer guide him through it. By storing calibration information in association with product and/or conveyor line information, the printer is able to set up the sensors from memory under some circumstances, avoiding the need to perform a sensor calibration operation. This can make the printer set-up procedure substantially faster and simpler for the operator.

The embodiments discussed above are not limiting, and further alternative arrangements are possible.

The invention claimed is:

1. A non-contact printer comprising a print head for printing onto a succession of objects carried past the print head by a conveyor, at least one sensor for detecting the approach of an object to be printed onto, control means and a user interface, the printer having a sensor calibration mode in which (i) it instructs the operator, via the user interface, to present a background condition to the sensor and, following an input from the operator that a background condition has been presented to the sensor, controls the sensor so as to determine the background threshold sensitivity level of the sensor, the background threshold sensitivity level of the sensor being the sensitivity level of the sensor such that at higher sensitivities the sensor provides a detection output when the background condition is presented to the sensor and at lower sensitivities the sensor fails to provide a detection output when the background condition is presented to the sensor, and (ii) it instructs the operator, via the user interface, to present a sample object to the sensor for detection and, following an input from the operator that a sample object has been presented to the sensor, controls the sensor so as to determine the object threshold sensitivity level of the sensor, the object threshold sensitivity level of the sensor being the sensitivity level of the sensor such that at higher sensitivities the sensor provides a detection output when the sample object is presented to the sensor and at lower sensitivities the sensor fails to provide a detection output when the sample object is presented to the sensor, the printer being arranged to control the sensor so that during a printing operation subsequent to operation in the sensor calibration mode, the sensor has an operational sensitivity level that is between the background threshold sensitivity level and the object threshold sensitivity level.

2. A non-contact printer according to claim 1 which is arranged to store at least one of the background threshold sensitivity level, the object threshold sensitivity level and the operational sensitivity level in association with data identifying at least one of (a) the identity of the conveyor used during operation in the sensor calibration mode and (b) the type of object used as the sample object in operation in the sensor calibration mode.

3. A non-contact printer according to claim 2 which has a printer setup mode in which it responds to data identifying the conveyor at which a subsequent printing operation is to be carried out and/or data identifying the type of object to be printed onto during the print operation by retrieving at least one of the background threshold sensitivity level, the object threshold sensitivity level and the operational sensitivity level stored in association with the data identifying the conveyor and/or data identifying the type of object, and uses the retrieved sensitivity level or levels to set the operational sensitivity level of the sensor used in the subsequent printing operation.

4. A non-contact printer according to claim 1 in which the said at least one sensor comprises a first sensor and a second sensor, and the printer is arranged so that in operation (i) of the sensor calibration mode it determines both the background threshold sensitivity level of the first sensor and the background threshold sensitivity level of the second sensor, and in operation (ii) of the sensor calibration mode it determines both the object threshold sensitivity level of the first sensor and the object threshold sensitivity level of the second sensor provided that the sample object has been presented to both the first sensor and the second sensor.

5. A non-contact printer according to claim 1 in which the said at least one sensor comprises an optical sensor.

6. A non-contact printer according to claim 1 which is arranged to perform operation (i) of the sensor calibration mode before performing operation (ii) of the sensor calibration mode.

7. A non-contact printer according to claim 1 which is arranged to perform operation (ii) of the sensor calibration mode before performing operation (i) of the sensor calibration mode.

8. A non-contact printer according to claim 1 in which the said at least one sensor is attached to or mounted on the print head.

9. A non-contact printer according to claim 1 which is an ink jet printer.

10. A non-contact printer according to claim 1 which is a laser marking printer.

11. A method of operating a non-contact printer having a print head for printing onto a succession of objects carried past the print head by a conveyor, at least one sensor for detecting the approach of an object to be printed onto, and a user interface, the method comprising (i) instructing the operator, via the user interface, to present a background condition to the sensor and, following an input from the operator that a background condition has been presented to the sensor, controlling the sensor so as to determine the background threshold sensitivity level of the sensor, the background threshold sensitivity level of the sensor being the sensitivity level of the sensor such that at higher sensitivities the sensor provides a detection output when the background condition is presented to the sensor and at lower sensitivities the sensor fails to provide a detection output when the background condition is presented to the sensor, (ii) instructing the operator, via the user interface, to present a sample object to the sensor for detection and, following an input from the operator that a sample object has been presented to the sensor, controlling the sensor so as to determine the object threshold sensitivity level of the sensor, the object threshold sensitivity level of the sensor being the sensitivity level of the sensor such that at higher sensitivities the sensor provides a detection output when the sample object is presented to the sensor and at lower sensitivities the sensor fails to provide a detection output when the sample object is presented to the sensor, and (iii) subsequently controlling the sensor during a printing operation so that the sensor has an operational sensitivity level that is between the background threshold sensitivity level and the object threshold sensitivity level.

12. A method according to claim 11 in which at least one of the background threshold sensitivity level, the object threshold sensitivity level and the operational sensitivity level is stored in association with data identifying at least one of (a) the identity of a conveyor used in step (i) and (b) the type of object used as the sample object in step (ii).

13. A method according to claim 12 which comprises responding to data identifying the conveyor at which a printing operation is to be carried out and/or data identifying the type of object to be printed onto during the print operation by retrieving at least one of the background threshold sensitivity level, the object threshold sensitivity level and the operational sensitivity level stored in association with the data identifying the conveyor and/or data identifying the type of object, and setting the operational sensitivity level of the sensor used in the printing operation by using the retrieved sensitivity level or levels.

14. A method according to claim 11 in which the said at least one sensor comprises a first sensor and a second sensor, and in which step (i) comprises determining both the background threshold sensitivity level of the first sensor and the background threshold sensitivity level of the second sensor, and step (ii) comprises determining both the object threshold sensitivity level of the first sensor and the object threshold sensitivity level of the second sensor provided that the sample object has been presented to both the first sensor and the second sensor.

15. A method according to claim 11 in which step (i) is performed before step (ii).

16. A method according to claim 11 in which step (ii) is performed before step (i).

* * * * *